US007163433B2

(12) United States Patent
Chou

(10) Patent No.: US 7,163,433 B2
(45) Date of Patent: Jan. 16, 2007

(54) ADHESIVE STRAPLESS BRASSIERE

(75) Inventor: Hsien-Wei Chou, Taipei (TW)

(73) Assignees: Bravo Universal Co., Ltd., Taichung (TW); Ce Soir Lingerie Co., Inc., Ventura, CA (US)

( * ) Notice: Subject to any disclaimer, the term of this patent is extended or adjusted under 35 U.S.C. 154(b) by 0 days.

(21) Appl. No.: 10/950,040

(22) Filed: Sep. 24, 2004

(65) Prior Publication Data

US 2005/0221719 A1 Oct. 6, 2005

(30) Foreign Application Priority Data

Apr. 6, 2004 (TW) ..... 93205232 U

(51) Int. Cl.
*A41C 3/00* (2006.01)

(52) U.S. Cl. ..... 450/81; 450/58; 450/54; 2/267

(58) Field of Classification Search ..... 450/38, 450/54–57, 81, 86, 88; 2/267, 268; 623/7, 623/8

See application file for complete search history.

(56) References Cited

U.S. PATENT DOCUMENTS

| | | | | |
|---|---|---|---|---|
| 2,869,553 | A * | 1/1959 | D' Or | 450/81 |
| 3,280,818 | A * | 10/1966 | Pankey et al. | 450/81 |
| 4,992,074 | A * | 2/1991 | Diaz | 450/81 |
| 5,755,611 | A * | 5/1998 | Noble et al. | 450/39 |
| 6,383,055 | B1 * | 5/2002 | Valentin | 450/81 |
| 6,758,720 | B1 * | 7/2004 | Chen | 450/57 |
| 6,814,648 | B1 * | 11/2004 | Chong | 450/81 |

* cited by examiner

*Primary Examiner*—Gloria M. Hale
(74) *Attorney, Agent, or Firm*—SoCal IP Law Group LLP; Marvin E. Jacobs

(57) ABSTRACT

An adhesive strapless brassiere used for giving lift to a user's breast has two adhesive breast covers, a connector and a backing layer. Each adhesive breast cover is formed from a thin, pliable sheet and has a main, oblong first portion for covering a breast, and a vertical wing extending upwardly from the outside top edge. The adhesive breast covers are directly attached to a user's body by the adhesive. The connector is mounted between the two adhesive breast covers, and the backing layer is used to attach the adhesive breast covers before use. The adhesive strapless brassiere has a small volume and breathes, so a user will feel comfortable when wearing the brassiere. Furthermore, the adhesive strapless brassiere may be discarded after use.

7 Claims, 7 Drawing Sheets

ADHESIVE STRAPLESS BRASSIERE

BACKGROUND OF THE INVENTION

1. Field of Invention

The present invention relates to a strapless brassiere, and more particularly to an adhesive strapless brassiere.

2. Description of the Related Art

Conventional brassieres are used to protect and beautify a women's breast and have cups, a cup frame, shoulder straps, and an elastic band. Strapless brassieres have been developed to be worn with formal strapless gowns and the like so the shoulder straps would not be visible. An adhesive brassiere comprising two silicone cups that attached directly to a woman's breast has been developed for use with clothing that has an open back so that no elastic band is visible.

However, the conventional adhesive brassiere often has an excessively large volume and cannot breathe. Further, the conventional adhesive strapless brassiere is expensive. Therefore, a need exists for an adhesive strapless brassiere that has a small volume, breathes and is inexpensive.

SUMMARY OF THE INVENTION

The primary objective of the present invention is to provide an adhesive strapless brassiere that has a small volume and breathes.

To achieve the objective, the adhesive strapless brassiere in accordance with the present invention has two adhesive breast covers, a connector and a backing sheet. The adhesive breast covers are formed from a thin layer and are directly attached to a user's body by an adhesive layer. The connector is mounted between the two adhesive breast covers and the backing layer is removed releasaly attached to before use.

The adhesive strapless brassiere in accordance with the present invention has a small volume for a user and breathes, so a user will feel comfortable when wearing the brassiere. Furthermore, the adhesive strapless brassiere may be discarded after use.

Other objectives, advantages and novel features of the invention will become more apparent from the following detailed description when taken in conjunction with the accompanying drawings.

DETAILED DESCRIPTION OF THE INVENTION

Figure 1:
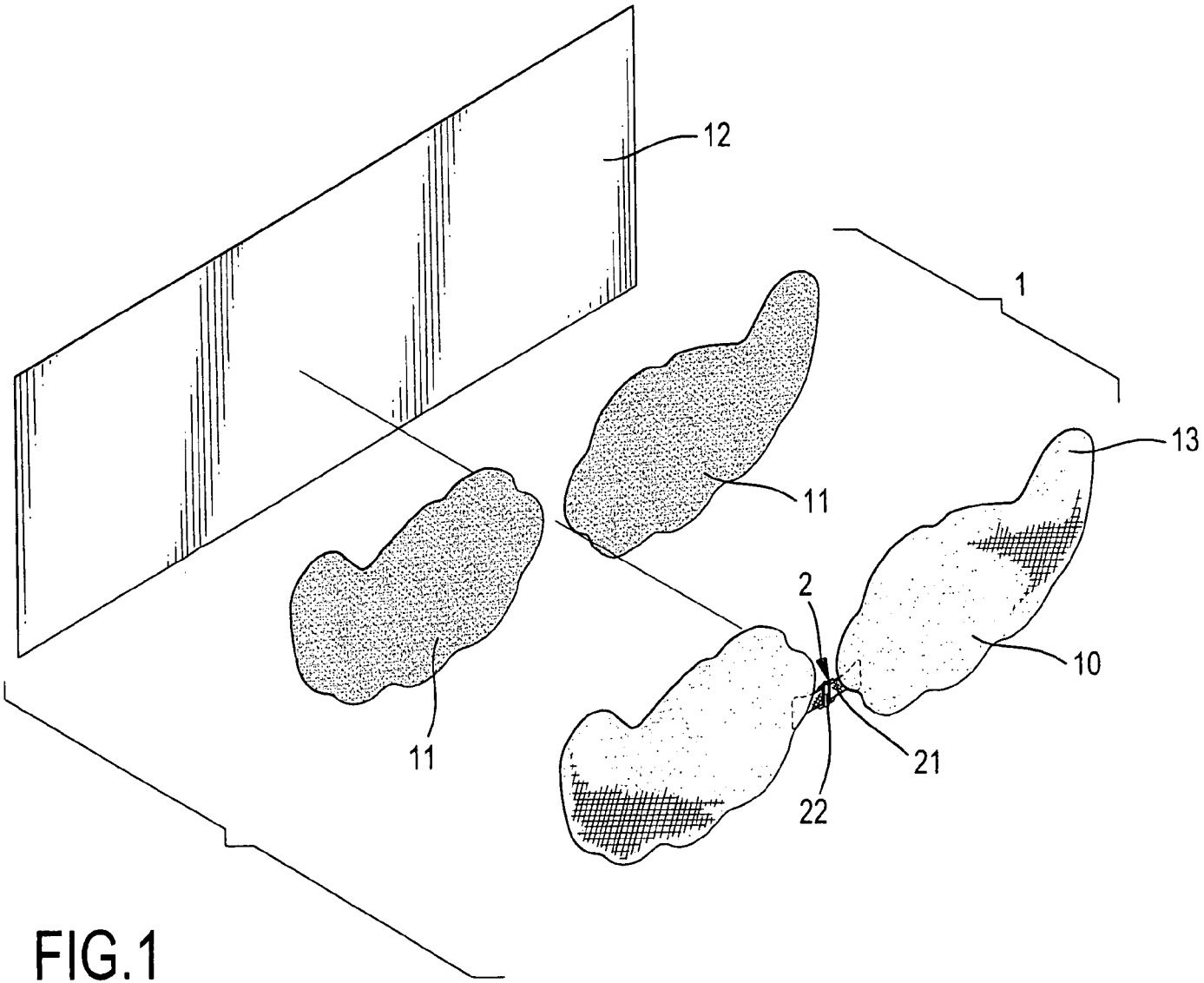
FIG. 1 is an exploded perspective view of an adhesive strapless brassiere in accordance with the present invention.
Figure 2:
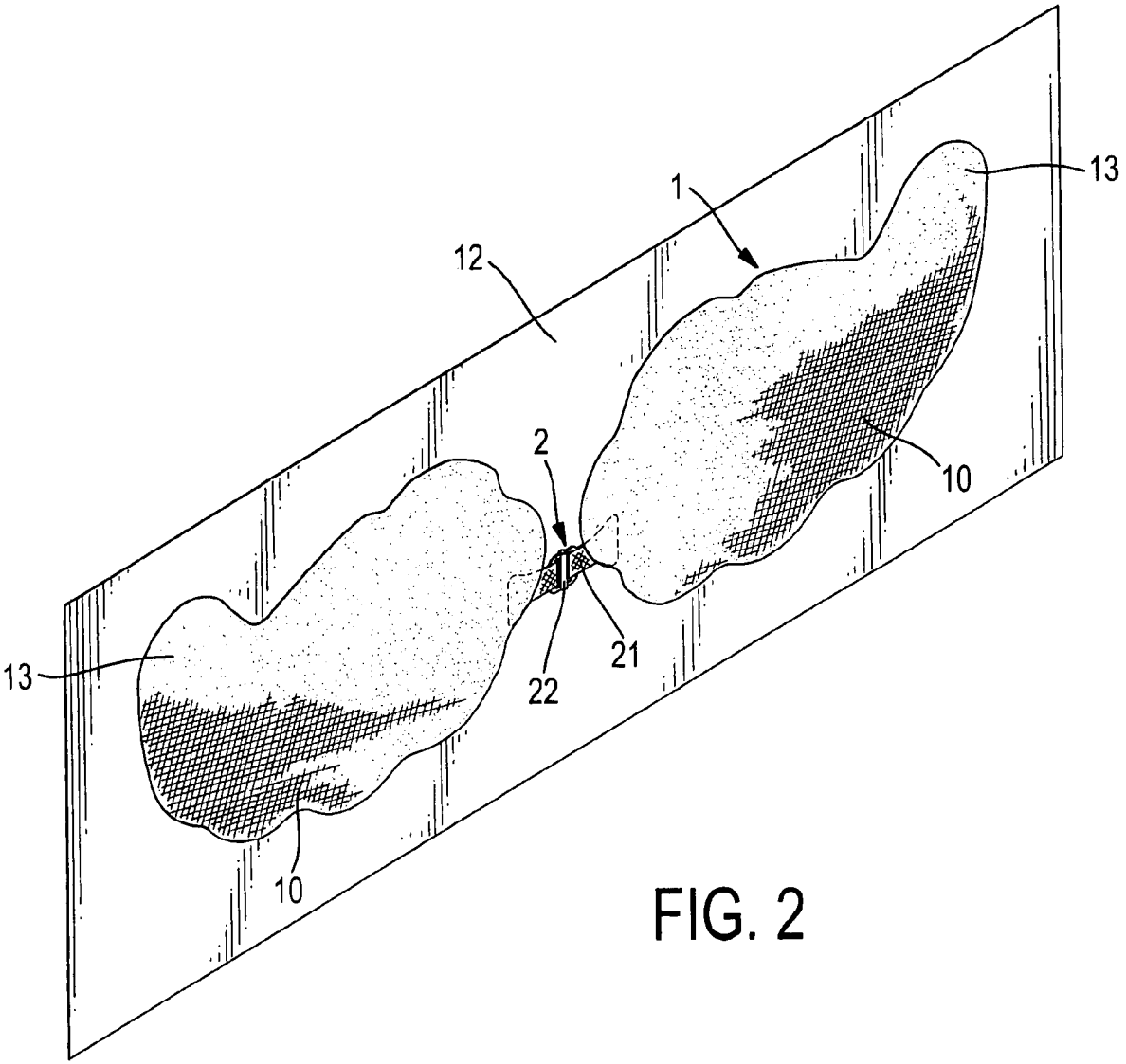
FIG. 2 is a perspective view of the adhesive strapless brassiere shown in FIG. 1.
Figure 3:
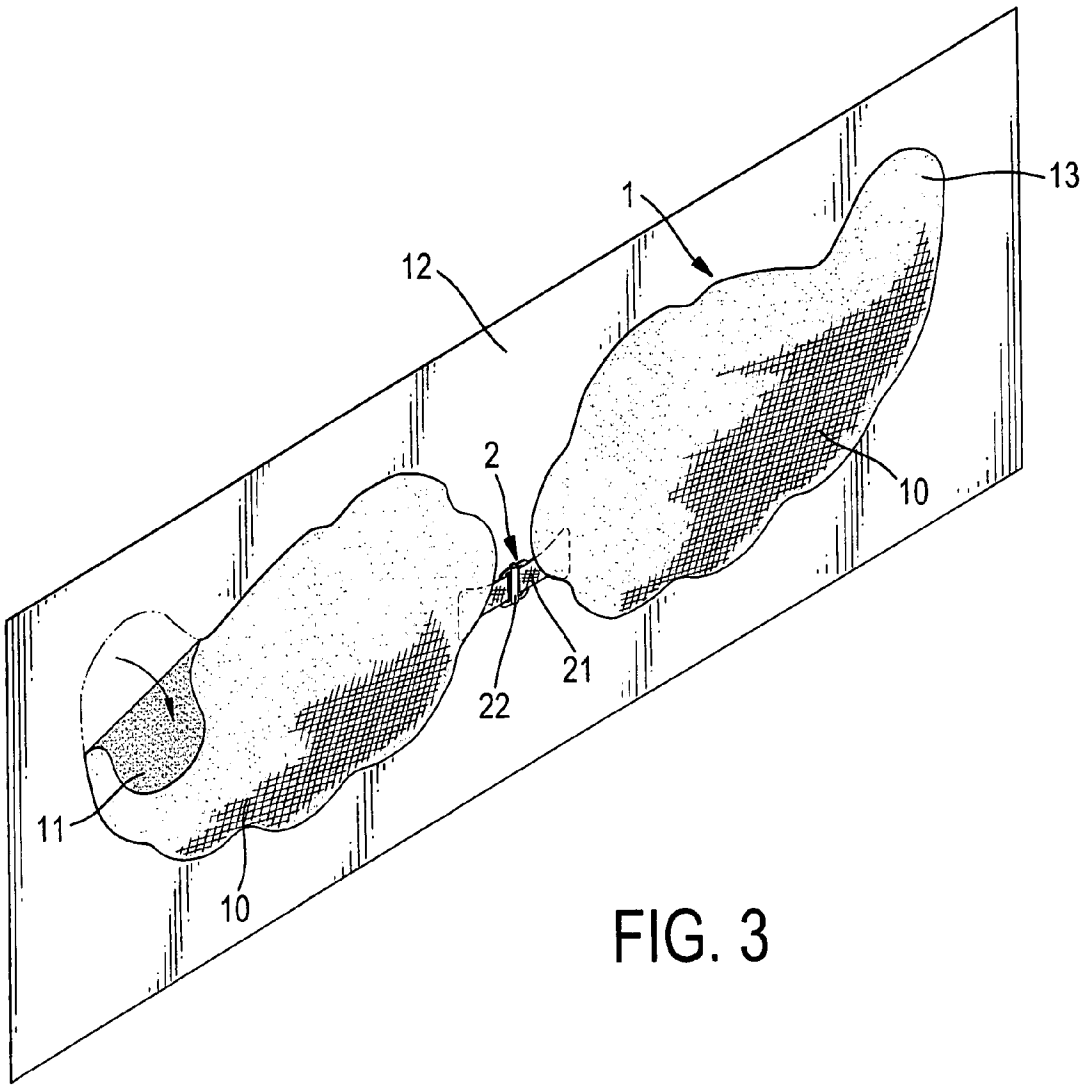
FIG. 3 is a perspective view of the adhesive strapless brassiere shown in FIG. 1 with part of an adhesive breast cover peeled off a backing layer.
Figure 4:
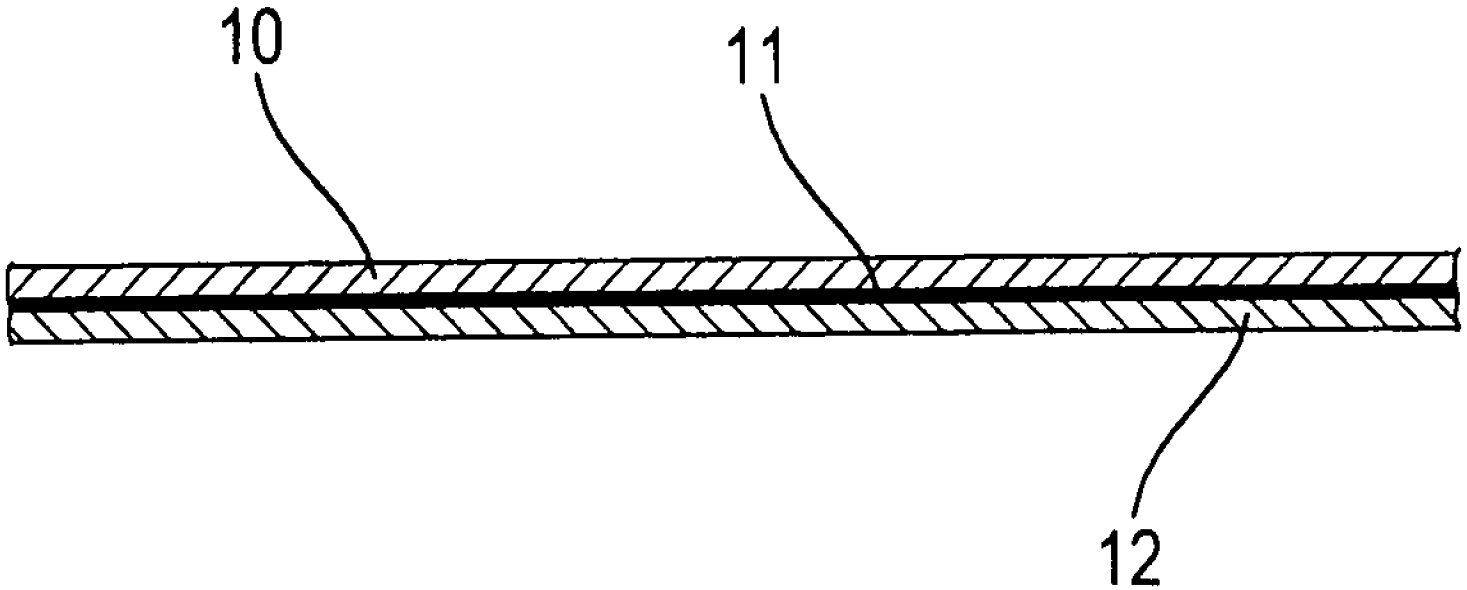
FIG. 4 is a side view in partial section of the adhesive strapless brassiere shown in FIG. 1.

With reference to FIGS. 1 to 4, an adhesive strapless brassiere in accordance with the present invention has two adhesive breast covers (1), a connector (2) and a backing layer (12).

Each adhesive cup (1) has a pliable breast cover (10), an adhesive layer (11) and an optional wing (13). The pliable (10) can be made from any material that can be formed in sheets, such as textiles, silicone or plastic. In a preferred embodiment, the pliable breast covers (1) are made from a thin layer of a textile. Each pliable breast cover (1) has a top convex edge, a rounded inner edge, an outer upwardly sloping edge and an inner surface. The adhesive layer (11) is bonded to the inner surface of the pliable breast cover (10) to form a contact surface and holds the adhesive breast cover (1) in place on a woman's breast without straps or bands. The adhesive layer (11) may be applied to the inner surface of the pliable breast cover as a layer or as a grid. An optional wing (13) is an integral part of the pliable breast cover (10) and extends upwardly from the top and outer side edges to form an upwardly extending wing (13). The optional wing (13) increases the contact surface of the adhesive breast cover (1) so the adhesive breast cover (1) will provide additional support for a women's breast.

Figure 5:
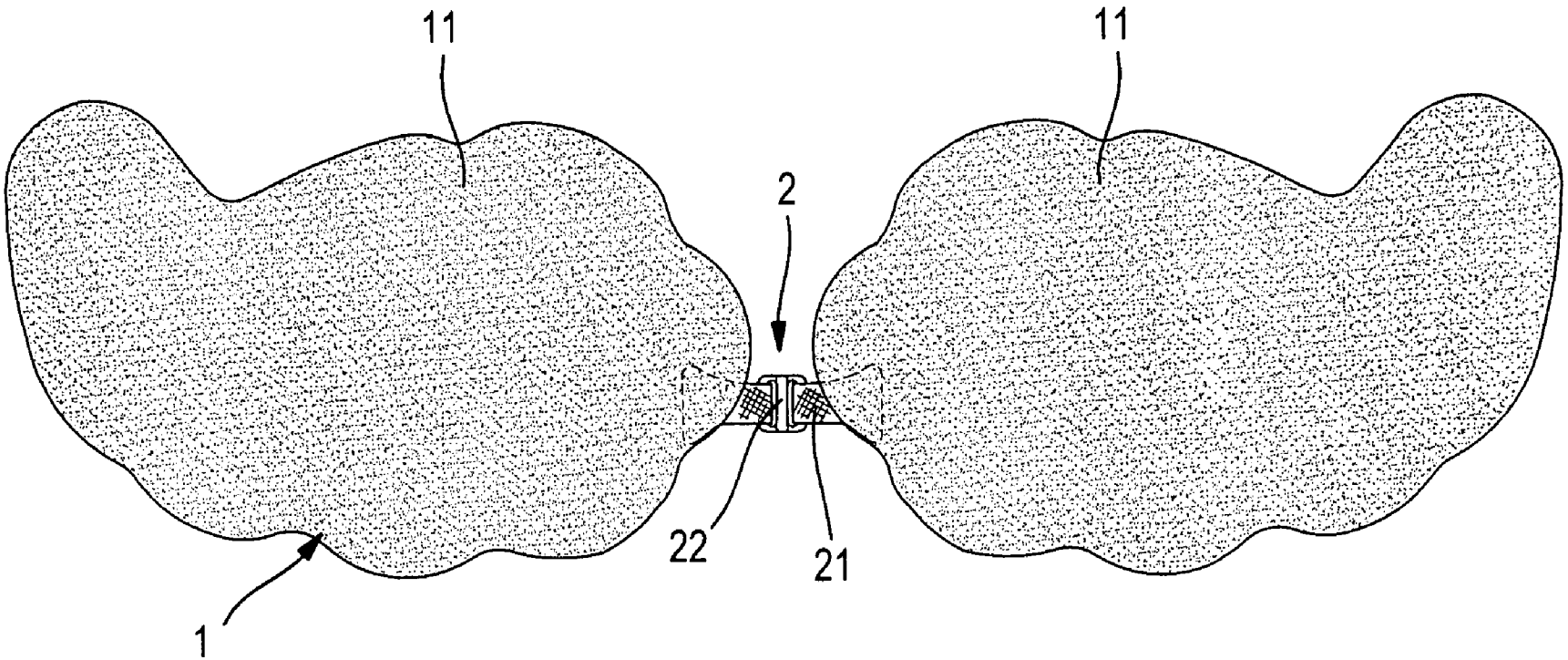
FIG. 5 is a rear view of the adhesive strapless brassiere shown in FIG. 1 without the backing layer.
Figure 6:
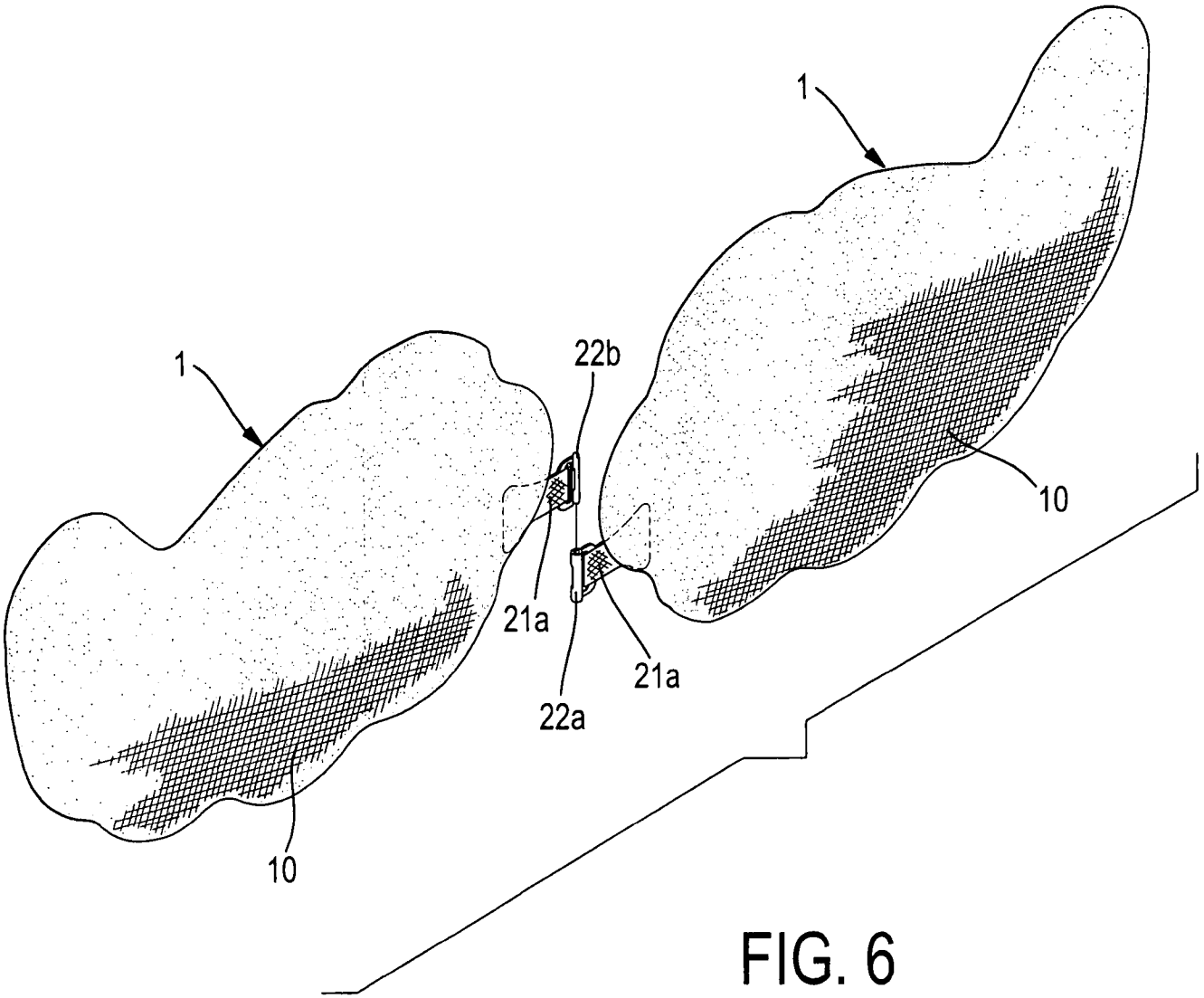
FIG. 6 is a perspective view of the adhesive strapless brassiere shown in FIG. 1 without the backing layer.

The connector (2) is mounted between the two adhesive breast covers (1) and can be formed in many shapes, such as a hook or a transverse strap. In a preferred embodiment, the connector (2) is a hook assembly (22). With further reference to FIGS. 5 and 6, the hook assembly (22) has two tabs (21), a transverse eye (22*a*) and a transverse hook (22*b*). The tabs (21) are attached respectively to the inner edges of the pliable cups (10), and each tab (21) has a free end (21*a*). The transverse hood (22*b*) and the transverse eye (22*a*) are securely attached respectively to the free ends (21*a*) of the tabs (21). The transverse hood (22*b*) and the transverse eye (22*a*) attach to each other.

The backing layer (12) has a contact surface on which the adhesive breast covers (1) are attached. The contact surface can be any material to which the adhesive breast covers (1) will attach and from which the adhesive breast covers (1) can be peeled easily. Furthermore, the backing layer (12) can be shaped to correspond to the adhesive cups breast covers (1).

Figure 7:
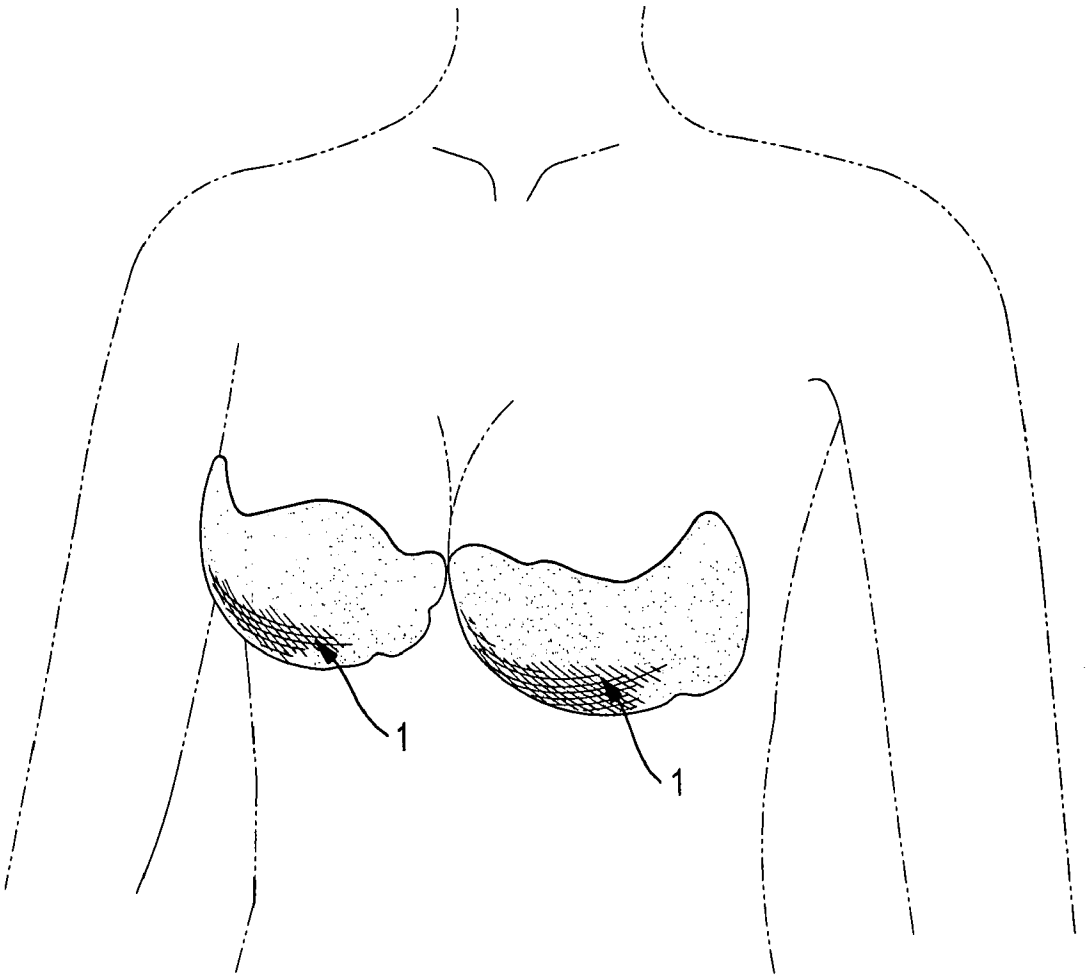
FIG. 7 is an operational perspective view of the adhesive strapless brassiere shown in FIG. 1.

With reference to FIG. 7, when the adhesive strapless brassiere is used, the breast covers (1) are peeled from the backing layer (12). The adhesive (11) on the adhesive breast covers (1) is attached to a user's body, then transverse eye (22*a*) is attached to the transverse hood (22*b*). The adhesive strapless brassiere in accordance with the present invention provides a self-supporting form giving lift and support for the breasts while also adding to their apparent size.

The adhesive strapless brassiere has the following advantages.

1. The adhesive strapless brassiere is formed in a sheet and is thin, so the adhesive brassiere has a small volume.

2. The adhesive strapless brassiere in accordance with the present invention can be made from a textile, so the adhesive strapless brassiere breathes and a user will not feel damp.

3. The adhesive strapless brassiere can be made inexpensively and can be discarded after use. Also, the adhesive strapless brassiere is inexpensive for a user.

The invention may be varied in many ways by a person skilled in the art. Such variations are not to be regarded as a departure from the spirit and scope of the invention, and all such modifications are intended to be included within the scope of the following claims.

What is claimed is:

1. An adhesive strapless brassiere having two adhesive breast covers, each adhesive breast cover being formed of a flat pliable sheet, each said breast cover being integral and having a peripheral surface including;

a top edge including a convex portion having first and second ends, a rounded inner edge joined to the first end of the top edge, an upwardly sloping, curved outer edge extending above said convex portion of the top edge forming a side of a vertical wing, the wing having a convex portion at the top periphery and an inner edge joined to the second end of the top edge, an inner surface, an outwardly facing adhesive layer substantially coating and directly bonded to the inner surface of each pliable breast cover, a connector mounted between the two adhesive breast covers, and a peelable backing layer attached to the adhesive layer.

2. The adhesive strapless brassiere as claimed in claim 1, wherein the adhesive layer is applied to substantially cover the inner surface of each pliable breast cover.

3. The adhesive strapless brassiere as claimed in claim 1, wherein the connector is a hook assembly having two tabs attached respectively to the inner edges of the pliable cups, and each tab having a free end, a transverse eye securely attached to the free end of one of the tabs, and a transverse hook securely attached to the free end of one of the tabs and engaged with the transverse eye.

4. The adhesive strapless brassiere as claimed in claim 3, where each pliable breast cover is made from a thin textile sheet.

5. The adhesive strapless brassiere as claimed in claim 1, wherein the connector is a hook assembly having two tabs attached respectively to the inner edges of the pliable breast covers, and each tab having a free end, a transverse eye securely attached to the free end of one of the tabs, and a transverse hook securely attached to the free end of one of the tabs and engaged with the transverse eye.

6. The adhesive strapless brassiere as claimed in claim 1 in which the flat pliable sheet is selected from the group consisting of a textile, silicone or plastic.

7. The adhesive strapless brassiere according to claim 6 in which the flat pliable sheet is a breathable textile.

* * * * *